US007854418B2

(12) United States Patent
Idehara et al.

(10) Patent No.: US 7,854,418 B2
(45) Date of Patent: Dec. 21, 2010

(54) IMAGE FORMING APPARATUS INCLUDING SUPPORTING LEGS

(75) Inventors: Ryoh Idehara, Kawanishi (JP); Nobuhiko Kita, Suita (JP); Kazuyoshi Kondo, Toyonaka (JP); Yusuke Furuichi, Ikeda (JP); Tadashi Okano, Hitachi (JP); Genta Hagiwara, Ikeda (JP); Kaoru Tada, Toyonaka (JP); Sei Onuma, Ikeda (JP)

(73) Assignee: Ricoh Company, Ltd., Tokyo (JP)

( * ) Notice: Subject to any disclaimer, the term of this patent is extended or adjusted under 35 U.S.C. 154(b) by 797 days.

(21) Appl. No.: 11/691,693

(22) Filed: Mar. 27, 2007

(65) Prior Publication Data

US 2007/0246638 A1 Oct. 25, 2007

(30) Foreign Application Priority Data

Mar. 27, 2006 (JP) ..... 2006-086620
Sep. 22, 2006 (JP) ..... 2006-258055

(51) Int. Cl.
*A47B 91/00* (2006.01)

(52) U.S. Cl. ..... 248/188.8; 248/188

(58) Field of Classification Search ..... 248/188.8, 248/188.9, 677
See application file for complete search history.

(56) References Cited

U.S. PATENT DOCUMENTS 4,319,729 A * 3/1982 Lo ..... 248/188.7
5,388,792 A * 2/1995 Hastings et al. ..... 248/188.1
6,311,941 B1 * 11/2001 Feldmeyer ..... 248/188.8
7,611,106 B2 * 11/2009 Kondo et al. ..... 248/188
2005/0051685 A1 * 3/2005 Wu ..... 248/188.8

OTHER PUBLICATIONS

U.S. Appl. No. 12/118,989, filed May 12, 2008, Furuichi, et al.

* cited by examiner

*Primary Examiner*—A. Joseph Wujciak, III
(74) *Attorney, Agent, or Firm*—Oblon, Spivak, McClelland, Maier & Neustadt, L.L.P.

(57) ABSTRACT

An apparatus or an image forming apparatus including a main body having a first supporting leg configured to be connectable to the main body, a second supporting leg fixed to the main body, and the position of the main body to connect the first supporting leg is selectable. The apparatus may be stable on the installation surface if the center of gravity of the apparatus is transformed.

4 Claims, 9 Drawing Sheets

IMAGE FORMING APPARATUS INCLUDING SUPPORTING LEGS

CROSS-REFERENCE TO RELATED APPLICATIONS

The present application claims priority to Japanese Patent Application No. 2006-086620 filed Mar. 27, 2006 and Japanese Patent Application No. 2006-258055 filed Sep. 22, 2006, the disclosure of which are each incorporated herein by reference.

FIELD OF THE INVENTION

The present invention relates to an apparatus having a plurality of movable supporting legs to stabilize the apparatus.

BACKGROUND OF THE INVENTION

In an apparatus as an image forming apparatus, a measurement device, an electronic device, and an electric appliance, various type of supporting legs attached to the bottom of the apparatus is disclosed in the related art as following: Japanese Examined Patent Application No. 1992-40198, Japanese Patent Laid-Open Application No. 2001-22142, Japanese Patent Laid-Open Application No. 2001-51462, and Japanese Patent Laid-Open Application No. 2002-287452.

Specifically, the Japanese Patent Laid-Open Application No. 2001-51462 discloses an image forming apparatus that includes: a first abdominal plate having a bottom portion to which the first supporting leg or second supporting leg is provided, a second abdominal plate having a bottom portion that the first supporting leg or second supporting leg is provided, and connection plates that connect the first abdominal plate and the second abdominal plate.

More specifically, the Japanese Patent Laid-Open Application No. 2001-51462 discloses an image forming apparatus in which the supporting legs make a substantial triangle including the vertical projection of the center of gravity of the device on the installation surface.

The supporting leg should be disposed to keep the apparatus stably on the installation surface by considering the center of gravity of the apparatus. For example, in the apparatus having three supporting legs attached to the bottom of the apparatus which make a triangle on the installation surface, it is preferable that the triangle is made to include the vertical projection of the center of gravity of the apparatus.

The center of gravity of some apparatuses change by altering the configuration of the apparatus, as described below.

The image forming apparatus is configured by a main unit and an adjunct unit. The main unit may be a basic unit and the adjunct unit may be an optional unit. Generally, the center of gravity is widely moved when the optional unit is added to the basic unit. If the position of the supporting legs provided to the image forming apparatus is defined by considering only the center of gravity of the image forming apparatus having the basic unit, the image forming apparatus having the basic unit and the optional unit mounted on the basic unit may not be set stably on the installation surface. In contrast, if the position of the supporting legs are defined by considering only the center of gravity of the image forming apparatus having basic unit and the optional unit, the image forming apparatus having only the basic unit may not be set stably on the installation surface.

SUMMARY OF THE INVENTION

An apparatus or an image forming apparatus including a main body having a first supporting leg fixed to the main body, a second supporting leg configured to be connectable to the main body, and the position of the main body to connect the second supporting leg is selectable. The apparatus may be stable on the installation surface if the center of gravity of the apparatus is transformed.

BRIEF DESCRIPTION OF THE DRAWINGS

A more complete appreciation of the present invention, and many of the attendant advantages thereof, will be readily obtained as the same becomes better understood by reference to the following detailed description when considered in connection with the accompanying drawings, wherein.

DETAILED DESCRIPTION OF THE PREFERRED EMBODIMENTS

Figure 1:
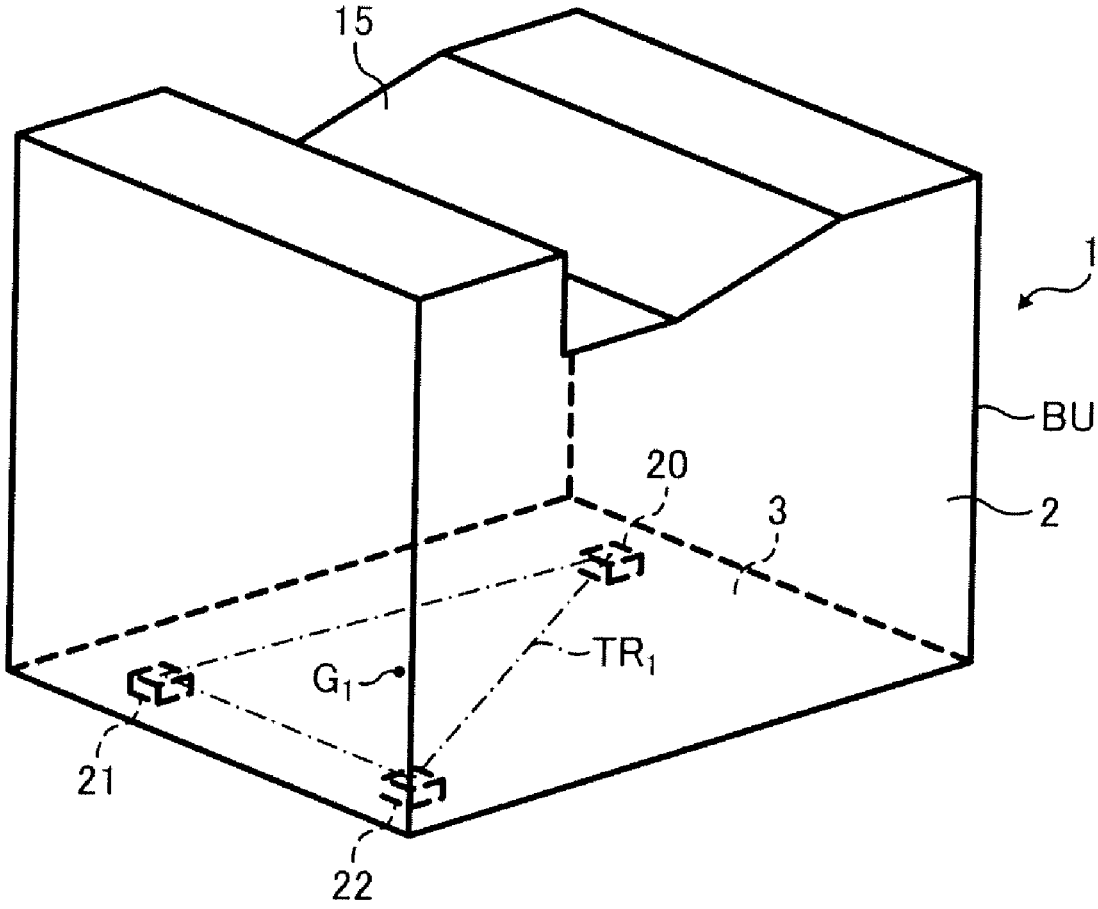
FIG. 1 is a perspective view showing an overall configuration of an image forming apparatus having only a basic unit according to an embodiment of the present invention.

Preferred embodiments of the present invention are described in detail referring to the drawings, wherein like reference numerals designate identical or corresponding parts throughout the several views.

Figure 3:
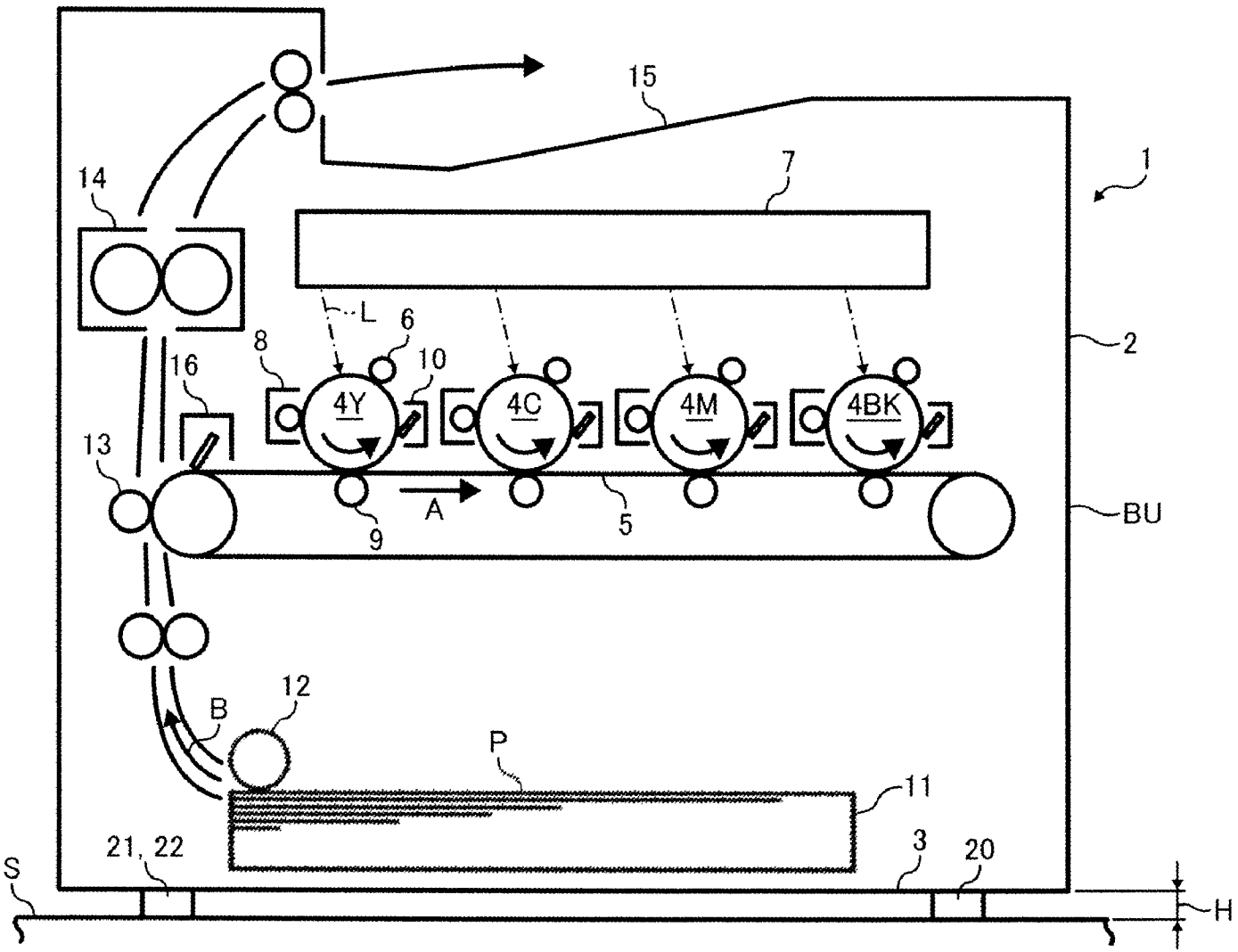
FIG. 3 is an enlarged cross-section view of an image forming apparatus according to an embodiment of the present invention.

FIG. 1 is a perspective view showing an overall configuration of the image forming apparatus having a basic unit indicated "BU" according to an embodiment of the present invention. FIG. 3 is a cross sectional view of the image forming apparatus having the basic unit depicted in FIG. 1

Figure 2:
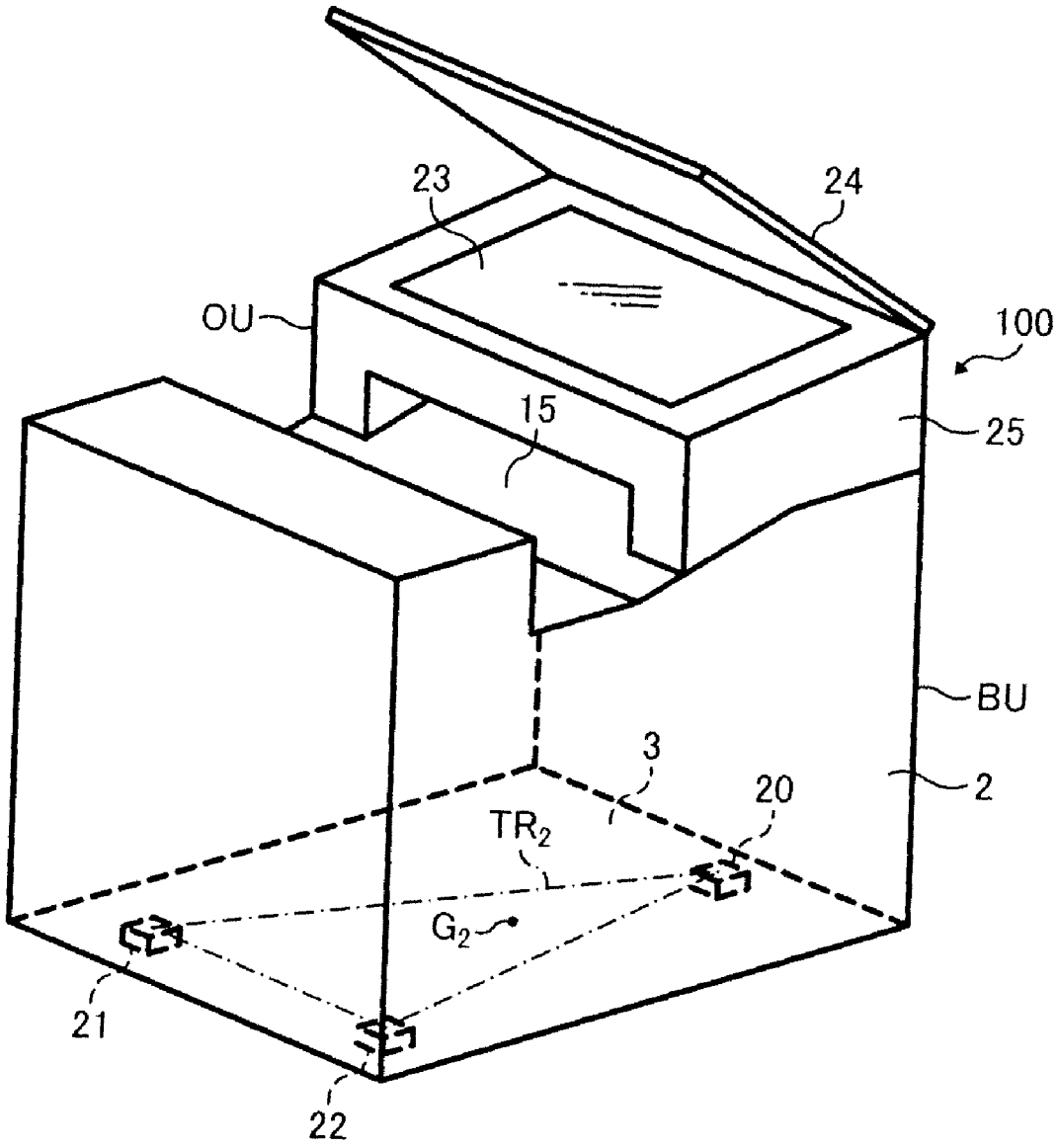
FIG. 2 is a perspective view of an image forming apparatus having basic unit and an optional unit mounted on the basic unit according to an embodiment of the present invention.

FIG. 2 is a perspective view of an image forming apparatus having a basic unit and an optional unit as indicated "OU" mounted on the basic unit according to an embodiment of the present invention.

As illustrated in FIG. 1 and FIG. 3, the main body 1 of the image forming apparatus includes a first chassis 2, a bottom plate 3 and various image forming devices provided in the first chassis 2. Supporting legs 20, 21, 22 are attached to the bottom plate 3 of the image forming apparatus.

As illustrated in FIG. 3, the first chassis 2 contains photo conductor drums 4Y, 4C, 4M, 4BK as image bearing members, and an intermediate transfer belt 5, which is held by a plurality of holding rollers.

Next, the process of forming an image will be described.

The photo conductor drums 4Y, 4C, 4M, 4BK are driven counterclockwise, and the intermediate transfer belt 5 is driven in the direction indicated by arrow A. The photo conductor drum 4Y is charged to predetermined polarity by a charging roller 6. Writing unit 7 irradiates laser beam L according to modulated signal to the charged surface of the photoconductor drum 4Y, and a latent image is formed on the photoconductor drum 4Y. A developer 8 develops the latent image with yellow toner and a toner image is formed as a visible image on the photoconductor drum 4Y. The toner image is electrically transferred to the intermediate transfer belt 5 by a first transfer roller 9. A first cleaning unit 10 removes residual toner from the photoconductor drum 4Y after the toner image is transferred to the intermediate transfer belt 5. In processes similar to that described above, a cyan toner image, a magenta toner image, and a black toner image are formed on each photoconductor drum 4C, 4M, and 4BK, and transferred to the intermediate transfer belt 5.

Below the intermediate transfer belt 5 is a sheet feeding device. The sheet feeding device includes a sheet feeding cassette 11 that accommodates recording medium P, which may include recording paper or a resin sheet, and a sheet feeding roller 12. The topmost recording medium P of the stack is fed by the sheet-feeding roller 12. The recording medium P is fed to the second transfer portion between the intermediate transfer belt 5 and a second transfer roller 13 that faces the intermediate transfer belt At the second transfer portion, the toner image on the intermediate transfer belt 5 is electrically transferred to the recording medium P by the second transfer roller 13, thus, forming a color toner image on the recording medium P.

The recording medium P then goes through a fixing device 14, which fixes the image to the recording medium P using heat and pressure. After passing through the fixing device 14, the recording medium P is discharged onto a discharging portion 15 formed at a topmost surface of the main body 2.

A second cleaning unit 16 for the intermediate transfer belt 5 removes a residual toner on the intermediate transfer belt 5 after transformation of the toner image to the recording medium P.

As illustrated FIG. 2, the main body 100 includes BU as the basic unit and OU as the optional unit mounted on the BU. In this embodiment the OU is an image scanner, which includes a second chassis 25, a contact glass 23 provided to top portion of the second chassis 25, and a pressing board 24 rotatably attached to the second chassis 25. The image scanner is configured to hold an original (not shown) on the contact glass 23 using the pressing board 24, and read the image of the original. The read image is then printed to the recording medium P as described above. The image forming apparatus illustrated FIG. 2 may function as both, or either, a copy machine and a printer, for example.

A user who requests the image forming apparatus having only the printer function can have the image forming apparatus illustrated in FIG. 1 and FIG. 3 (e.g., without the image scanner attachment). A user who requests the image forming apparatus having both printer and copy functions can have the image forming apparatus illustrated in FIG. 2 (e.g., with the document scanner attached). As described above, each image forming apparatus has BU as basic unit and OU as optional unit can mounted to the BU.

In the image forming apparatus as illustrated in FIG. 1 and FIG. 2, a first chassis 2 includes a bottom plate 3 and various image forming devices provided in the first chassis 2. The supporting legs 20, 21, 22 are provided on the bottom of the first main body 1 or second main body 100. The supporting legs 20, 21, 22 hold the first main body 1 or the second main body 100 on an installation surface S. In this embodiment the supporting legs 20, 21, 22 are provided on the bottom plate 3 of the first main body 1 or the second main body 100. Lines that connect the supporting legs 20, 21, 22 make triangles TR1, TR2.

As illustrated in FIG. 1 and FIG. 2, the center of gravity of the first main body 1 is defined as "G1," and the center of gravity of the second main body 100 is defined as "G2." The vertical projection of G1, G2 to the installation surface is defined as "g1," and "g2," respectively. The supporting legs 20, 21, 22 are configured such that g1 is within the perimeter of TR1, and g2 is within the perimeter of TR2. By such a configuration, the first main body 1 and the second main body 100 are stable.

If the first main body 1 or second main body 100 become distorted; the quality of the color image on the recording medium may decrease. Even if the image forming apparatus is a black and white printer or copying machine, the quality of the image may be decrease. The image quality may be improved by setting the first main body 1 or second main body 100 at three point.

It is preferable that the triangles TR1 or TR2 made by the lines that connect the supporting legs 20, 21, 22 include the vertical projections g1 or g2 of the center of gravity of the apparatus as projected on the installation surface. Specifically, it is preferable that the center of gravity of the triangle is approximated to the vertical projection as g1 or g2 of the center of gravity of the first main body 1 or second main body 100 to the installation surface.

In FIG. 2, the optional image scanner unit OP has remarkable weight. Also, the image scanner is provided biased far from the center of gravity G1 of the basic unit BU to allow for easy access of the recording medium P discharged on the discharging portion 15. For the reason described above, the center of gravity G1 of the main body 1 is positioned far from the center of gravity G2 of the main body 100. The center of gravity of the main body is transformed based on whether the main body includes the option unit or only the basic unit. Generally, a ratio of the option unit to basic unit may be from ¼ to ⅓.

As described above, since the center of gravity of the main body 1 or the main body 100 may be transformed based on whether the main body 1 or the main body 100 includes the option unit, the first main body 1 or the second main body 100 may not be set stable on the installation surface if the supporting legs 20, 21, 22 are permanently fixed to the same place of the bottom of the first main body 1 or the second main body 100.

Accordingly, in this embodiment, the position at which at least one of the supporting legs is connected to the bottom of the first main body 1 or the second main body 100 is selectable.

Figure 4A:
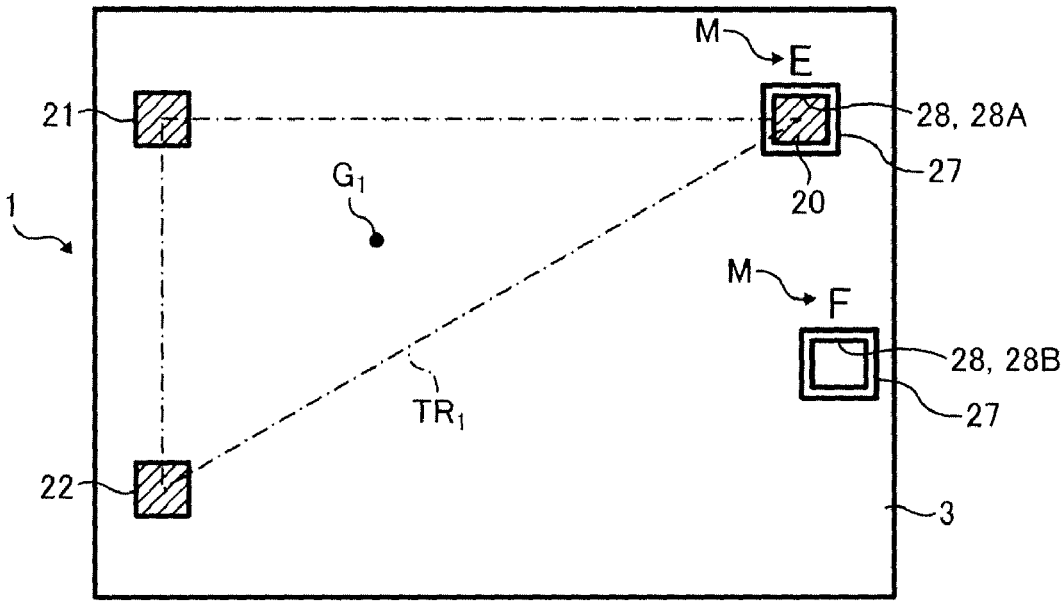
FIG. 4A is a horizontal view showing a configuration of supporting legs at a bottom plate of an image forming apparatus according to an embodiment of the present invention.

FIG. 4A is a horizontal view showing a configuration of the supporting legs 20, 21, 22 provided on a bottom plate 3 of the main body 1 that does not include option unit OU as illustrated in FIG. 1 and FIG. 3.

Figure 4B:
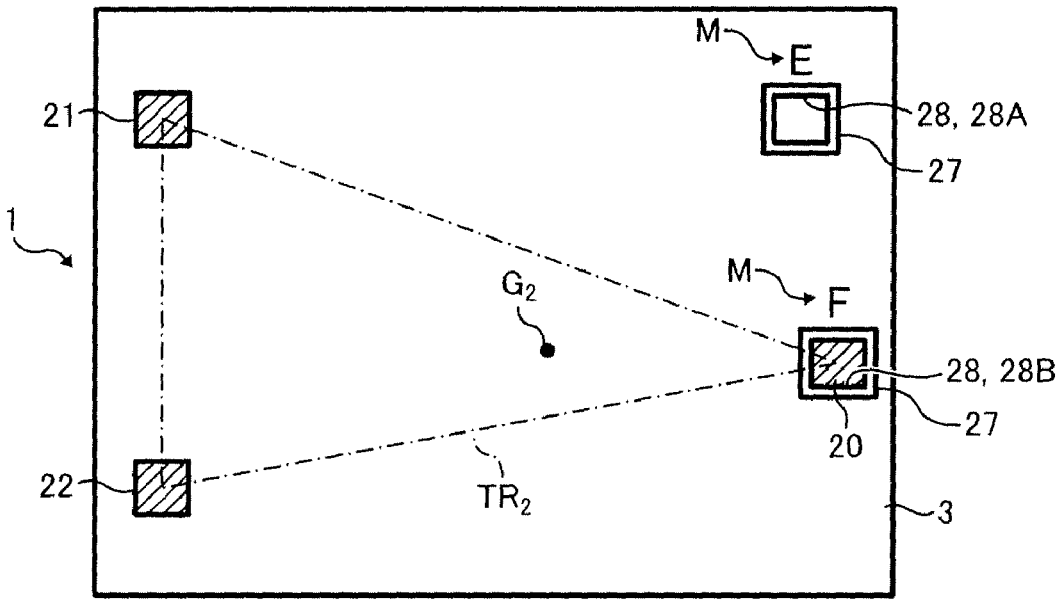
FIG. 4B is a horizontal view showing a configuration of supporting legs at a bottom plate of an image forming apparatus according to an embodiment of the present invention.

FIG. 4B is a horizontal view showing a configuration of the supporting legs 20, 21, 22 provided to a bottom plate 3 of the main body 100 including the option unit OU as illustrated in FIG. 2. As illustrated in FIG. 4A and FIG. 4B, the supporting legs 20, 21, 22 are indicated with hatching.

Figure 5A:
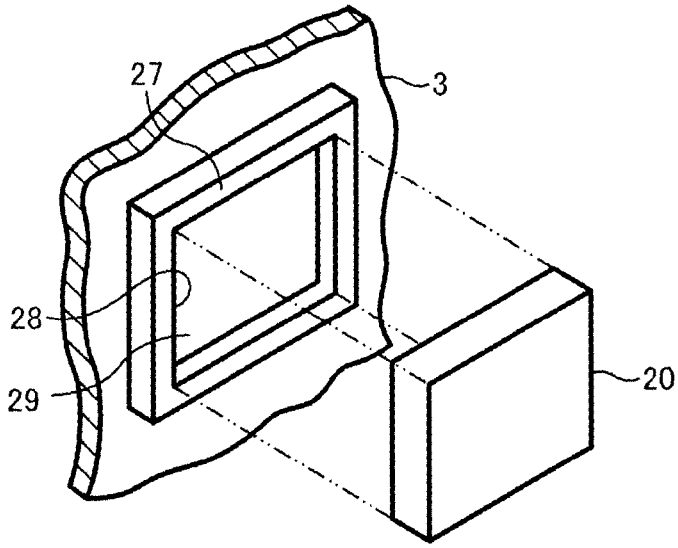
FIG. 5A is a perspective view showing a holding portion at a bottom plate of an image forming apparatus and a supporting leg configured to be connectable to the holding portion.
Figure 5B:
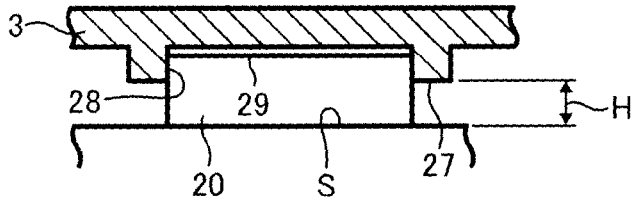
FIG. 5B is a cross-section view showing a holding portion at a bottom plate of an image forming apparatus and a supporting leg configured to be connectable to the holding portion.

In this embodiment supporting leg 20 is configured such that the part of the bottom of the first main body 1 or the second main body 100 connected to the supporting leg 20 is selectable. FIG. 4A and FIG. 5B show an example of a holding portion that attaches the supporting leg 20 to the bottom plate 3. As illustrated in FIG. 5A, a holding portion 28 is configured as a square trench that is provided at inside of a square-protruding portion 27 on the bottom plate 3. The supporting leg 20 is placed in the holding portion 28, and adhered by an adhesive to the bottom plate 3.

As illustrated in FIG. 4A and FIG. 4B, a plurality of the holding portions 28 are provided to the bottom plate 3. The holding portions 28 include a first holding portion 28A and a second holding portion 28B. In FIG. 4A, G1, as the vertical projection of center of gravity G1 of the first main body 1 to the installation surface, is illustrated. In the image forming apparatus having the first main body 1, the supporting leg 20 is attached to the first holding portion 28A of the bottom plate 28. By this configuration, G1 is provided in TR1. Specifically, it is preferable that G1 corresponds to the center of gravity of TR1, or G1 approximately corresponds to the center of gravity of TR1, as illustrated FIG. 4A. Thus, the first main body 1 is set stable on the installation surface S by the supporting legs 20, 21, 22.

In FIG. 4B, G2, as the vertical projection of center of gravity G2 of the second main body 100 to the installation surface, is illustrated. By this configuration supporting leg 20 is attached to the second holding portion 28B of the bottom plate 28 of the second main body 100, and G2 is provided in TR2. Specifically, it is preferable that G2 corresponds to the center of gravity of TR2, or G2 approximately corresponds to the center of gravity of the TR2, as illustrated FIG. 4B. Then, the second main body 100 is set stable on the installation surface S by the supporting legs 20, 21, 22.

As described above, if center of gravity GI of the image forming apparatus transforms to center of gravity G2, by choosing an appropriate holding portion 28, both the first main body 1 including the OU and the second main body 100 that does not include the OU may be stable on the installation surface S.

A plurality of holding portions 28 that are connectable with the supporting leg 20 are provided to the bottom of the main body 1. If the number of the holding portions 28 is greater than number of the supporting legs 20, the attaching position of the supporting leg 20 is selectable.

Numerous additional modifications and variations of the supporting leg and the holding portion are possible.

Figure 5C:
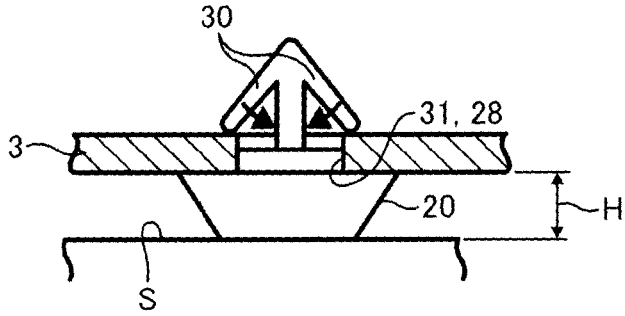
FIG. 5C is a cross-section view showing a holding portion at a bottom plate of an image forming apparatus and a supporting leg configured to be connectable to the holding portion.
Figure 5D:
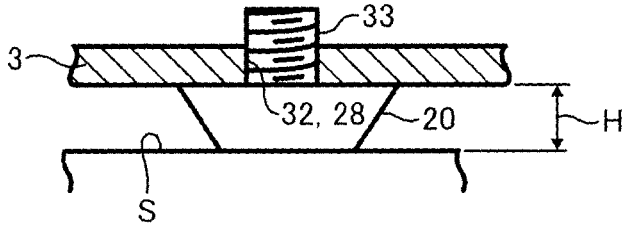
FIG. 5D is a cross-section view showing a holding portion at a bottom plate of an image forming apparatus and a supporting leg configured to be connectable to the holding portion.

In FIG. 5C, the holding portion 28 includes a through hole 31 in the bottom plate 3, and the supporting leg 20 is configured to elastically deform. The supporting leg 20 also includes a claw portion 30 inserted into the through hole 31 from the leading edge. When the claw portion goes through the through hole 31, the claw portion 30 deforms elastically, and after going through the through hole 31, the claw portion 30 returns to original form by elastic force preventing the supporting leg 20 from being removed. Additionally, in FIG. 5C, the holding portion 28 includes a screw hole 32 in the bottom plate 3, and the supporting leg 20 includes a screw axis 33. The screw axis 33 is twisted into the screw hole 32, thereby attaching the supporting leg 20 to the bottom plate 3.

Supporting legs 21, 22 may also be attached using the methods discussed above in relation to FIGS. 5A-5D. Additionally, supporting legs 21, 22 may be provided as a protruding portion of the bottom plate. Further, one or more of the plurality of supporting legs 21, 22 may be detachable.

In the case that a user who has the BU buys the OU later, the user can easily change the position of the supporting leg 20 from the position illustrated in FIG. 4A to the position illustrated in FIG. 4B. Additionally, in FIG. 5A or FIG. 5B, since the holding portion is configured as a ditch or hole, the user can attach the holding portion 28 to the supporting leg 20 easily.

As illustrated FIG. 3, and FIGS. 5B-5D, a distance H between the bottom plate 3 and bottom of the supporting legs is set to prevent the bottom of the image forming apparatus from hitting the installation surface S.

As illustrated in FIG. 4A or FIG. 4B, the first holding portion 28A and the second holding portion 28B are configured to be seen by the user. Specifically, the first holding portion 28A and/or the second holding portion 28B may be indicated by an eyemark M to attach the supporting leg 20. The eyemark M is indicated as E. F on the bottom plate 3. Eyemark E indicates the position that the supporting leg 20 when the first main body 1 does not include the option unit OU, and eyemark F indicates the position that the supporting leg 20 is attached when the first main body 100 includes the option unit OU.

By the eyemark M, a manufacturer and/or user can confirm the holding portion 28 to which the supporting leg 20 should be attached.

Figure 6:
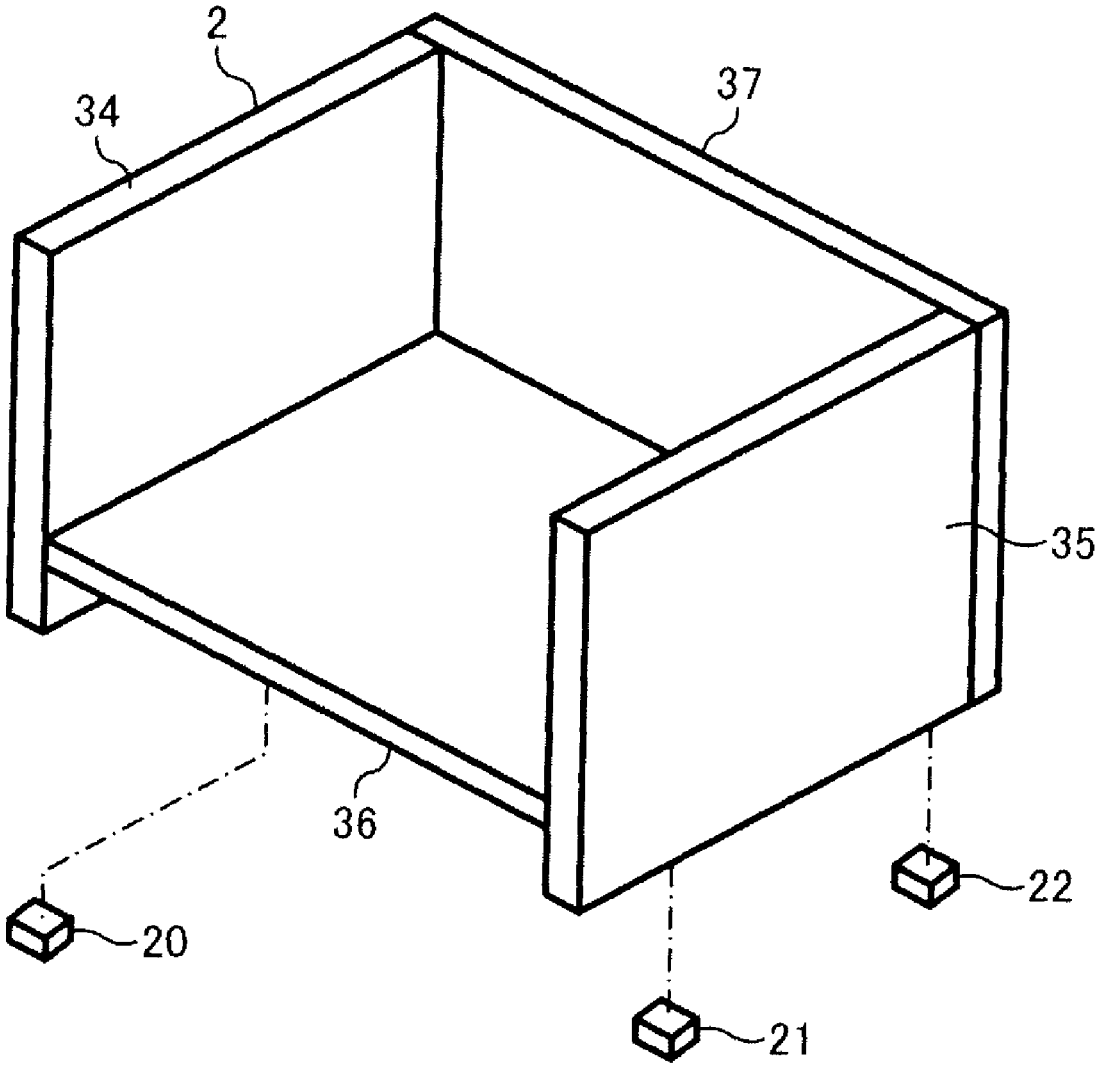
FIG. 6 is a perspective view showing an overall configuration of an image forming apparatus having a first abdominal plate having a bottom portion that provides a supporting leg and a second abdominal plate having a bottom portion that provides a supporting leg according to an embodiment of the present invention.
Figure 7:
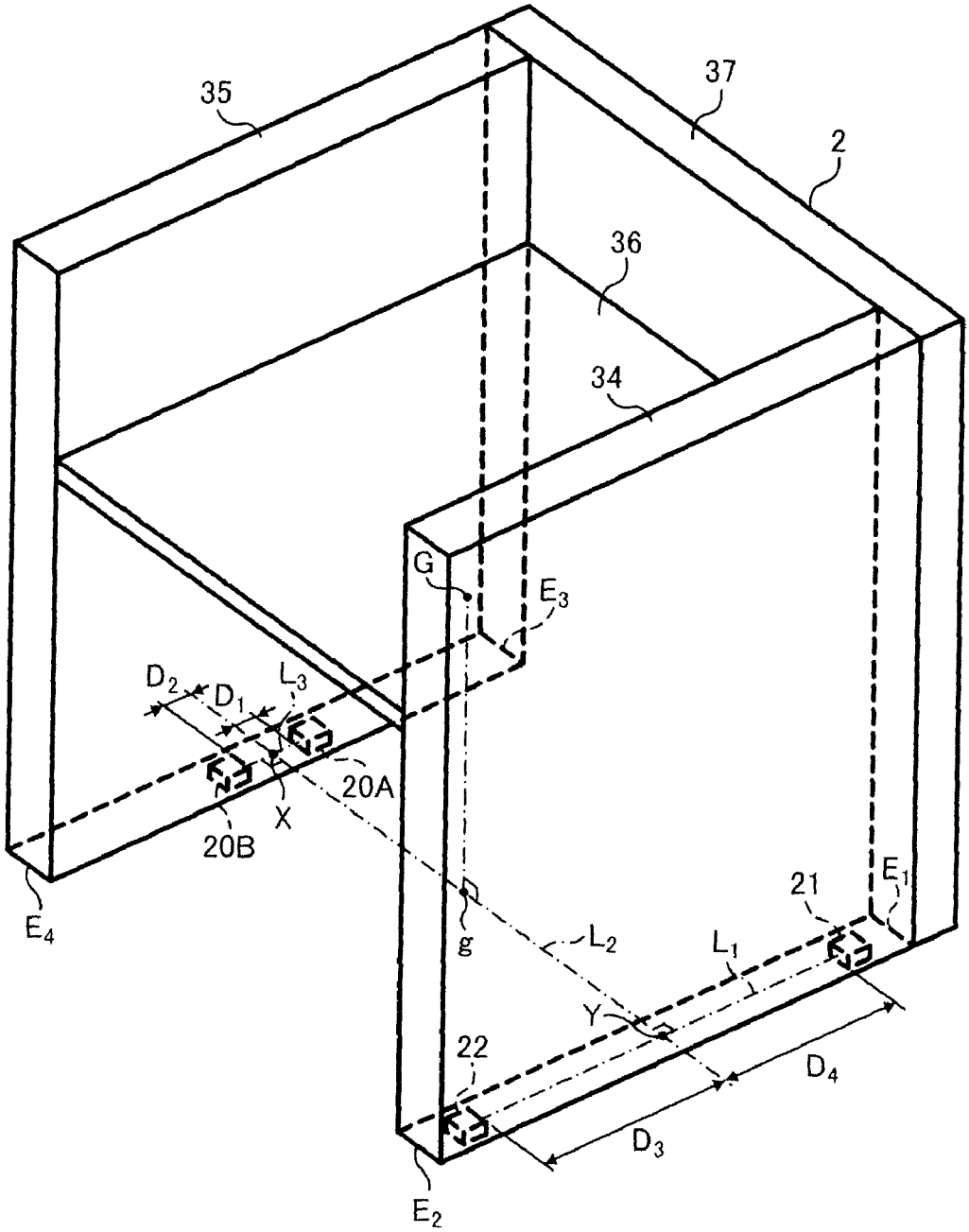
FIG. 7 is a perspective view showing an overall configuration of an image forming apparatus having a first abdominal plate having a bottom portion that provides a supporting leg and a second abdominal plate having a bottom portion that provides a supporting leg according to an embodiment of the present invention.

As illustrated in FIGS. 6-7, the first main body 1 or the second main body 100 includes a second abdominal plate 34 having a bottom portion to which the supporting legs 21 and 22 are attached, and a first abdominal plate 35 has a bottom portion to which the supporting leg 20 is attached. A first connection plate 36 connects the second abdominal plate 34 and the first abdominal plate 35, and a second connection plate 37 connects the second abdominal plate 34 and the first abdominal plate 35. The second abdominal plate 34 and the first abdominal plate 35 may be made by resin, or any other suitable material, and the supporting legs 20, 21, 22 may be made by metal, or any other suitable material. Since the weight of the first main body 1 or second main body 100 is supported by the second abdominal plate 34 and the first abdominal plate 35, the distortion of the first main body 1 or second main body 100 may be prevented.

In FIG. 7, supporting legs 21, 22 are attached to a bottom portion of the second abdominal plate 34, and supporting legs 20A, 20B are attached to a bottom portion of the first abdominal plate 35.

An intersection point of a line L1, which connects the supporting leg 21 and the supporting leg 22, with a line L2, that goes through g as the vertical projection of center of gravity G and perpendicular to the line L1 connecting the supporting leg 21 and the supporting leg 22, is defined as Y. Supporting leg 21 and supporting leg 22 face each other across Y, and are respectively biased to E1, E2 at an end of the second abdominal plate 34.

An intersection point of line L3, connecting the supporting leg 20A and the supporting leg 20B, with a line L4, that goes through g as the vertical projection of center of gravity G and perpendicular to line L3 connecting the supporting leg 20A and the supporting leg 20B, is defined as X. Supporting leg 20A and supporting leg 20B face each other across X and are biased to X of the first abdominal plate 35.

Additionally, the supporting legs have the following positional relationships:

a distance between the first supporting leg and X is defined as D1.

a distance between the second supporting leg and X is defined as D2.

a distance between the third supporting leg and Y is defined as D3.

a distance between the fourth supporting leg and Y is defined as D4.

a distance between the first supporting leg and the second supporting leg is defined as D5.

a distance between the third supporting leg and the fourth supporting leg is defined as D6.

D3 is greater than D1,

D3 is greater than D2.

D4 is greater than D1,

D4 is greater than D2, and a proportion of D6 to D5 is set from 5 to 3.

As described above, supporting legs 20A, 20B, and 21, 22 can make form a triangle including g as the vertical projection of center of gravity G. The first main body 1 and second main body 100 are set stable and distortion may be prevented even if the installation surface is uneven.

The substantial triangle including g as the vertical projection of center of gravity G can be applied in case that the center of gravity of the main body is transformed whether the main body includes the option unit on the basic unit or only the basic unit. An example is described as following.

Figure 8:
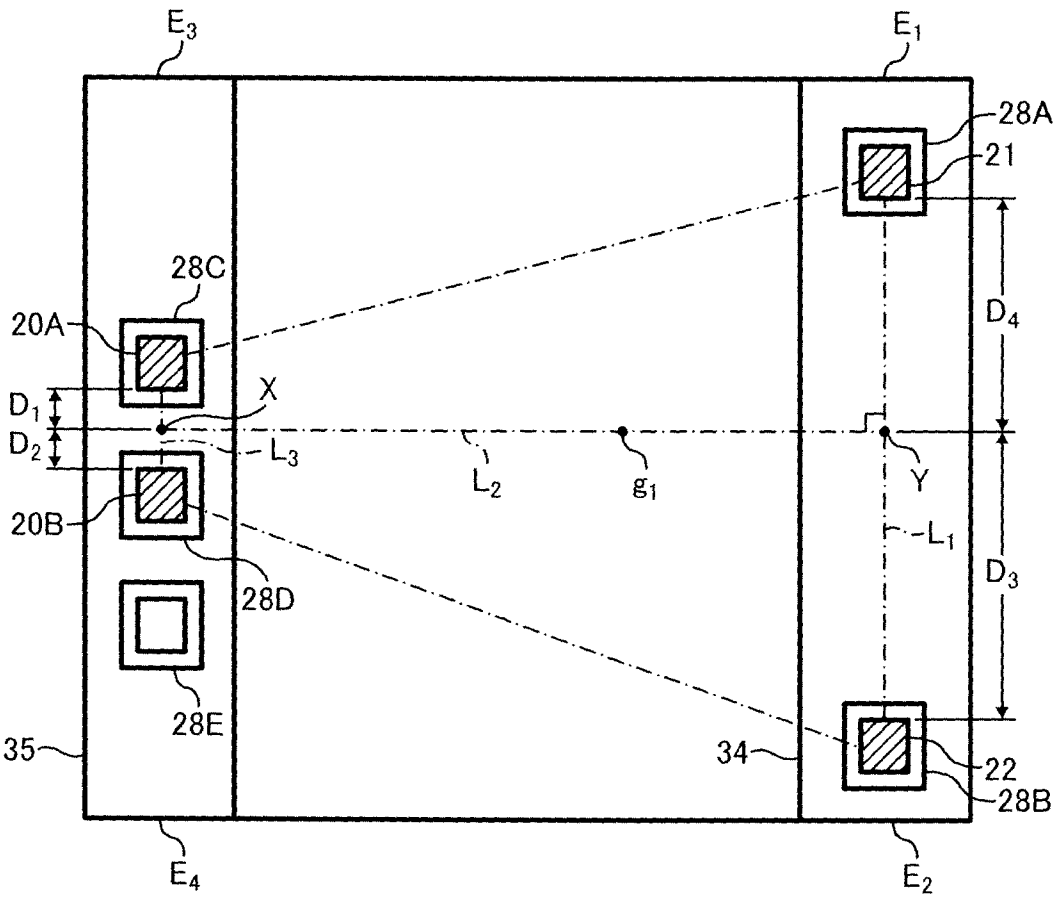
FIG. 8 is a horizontal view showing a configuration of a first abdominal plate having a bottom portion that provides a supporting leg and a second abdominal plate having a bottom portion that provides a supporting leg according to an embodiment of the present invention.
Figure 9:
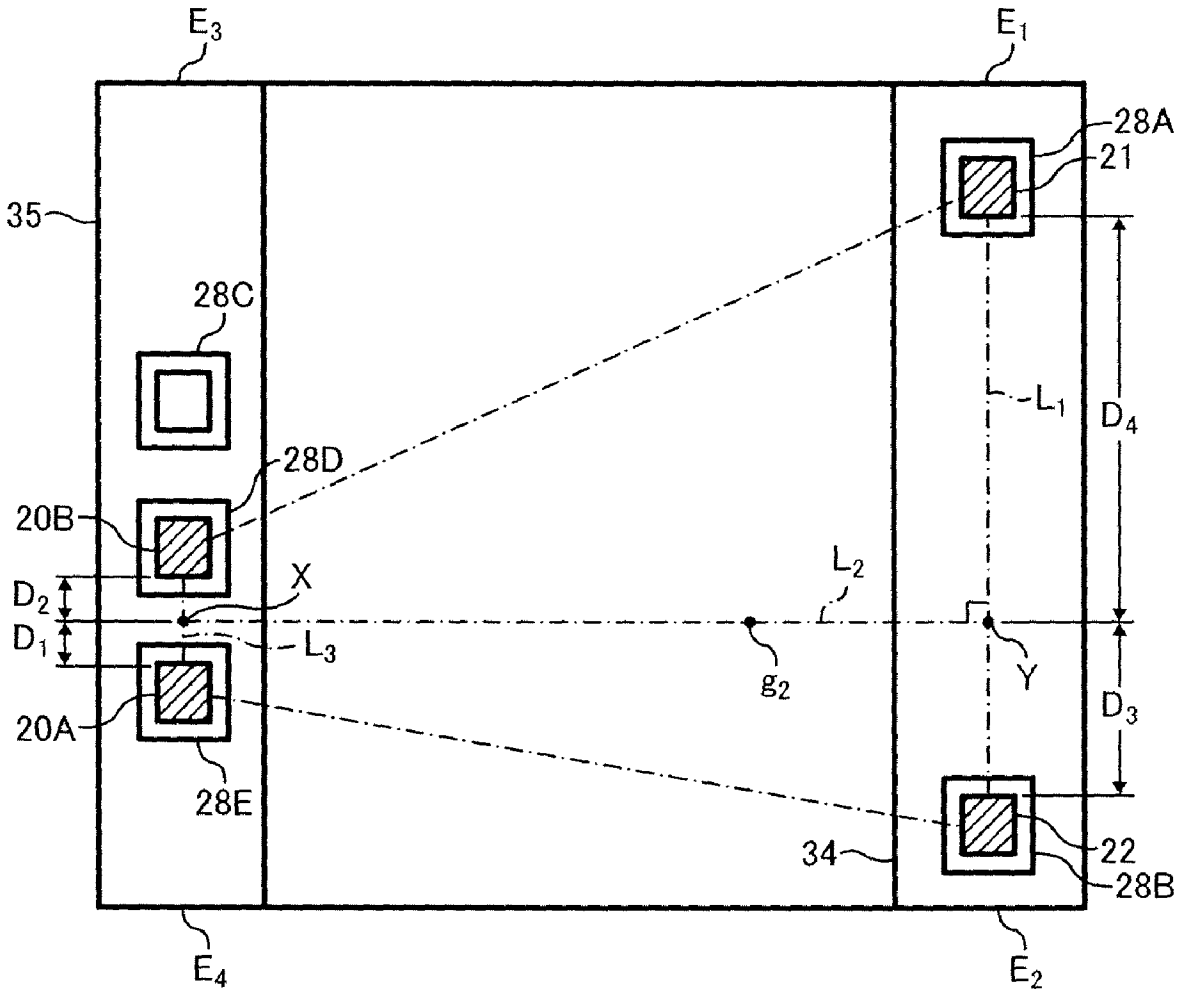
FIG. 9 is a horizontal view showing a configuration of a first abdominal plate having a bottom portion that provides a supporting leg and a second abdominal plate having a bottom portion that provides a supporting leg according to an embodiment of the present invention.

FIG. 8 and FIG. 9 are horizontal views showing a configuration of the square protruding portion 27 having holding portions 28A, 28B that hold the supporting legs 21 or 22, and the first abdominal plate 35 having holding portions 28C, 28D, and 28E that hold the supporting legs 20A or 20B.

Holding portions 28A, 28B, including the square protruding portion illustrated in FIG. 5, are provided at the bottom portion of the second abdominal plate 34, and supporting legs 21, 22 are fixed to holding portions 28A, 28B. Regardless of whether the image forming apparatus includes the OU, supporting legs 21, 22 are fixed to holding portions 28A, 28B. Holding portions 28C, 28D, and 28E include the square protruding portion illustrated in FIG. 5 at the bottom portion of the first abdominal plate 35.

As illustrated FIG. 8 and FIG. 9, supporting legs 20A, 20B, 21, and 22 are indicated with hatching.

When the vertical projection of the center of gravity of the image forming apparatus to the installation surface is g1, as illustrated in FIG. 8, supporting leg 20A is attached to holding portion 28C and supporting leg 20B is attached to holding portion 28D.

When the vertical projection of the center of gravity of the image forming apparatus to installation surface is g2, as illustrated in FIG. 9, supporting leg 20A is attached to holding portion 28E and supporting leg 20B is attached to holding portion 28D.

When g1 is transformed to g2, supporting leg 20A is detached from holding portion 28C and attached to holding portion 28E.

In this embodiment, supporting legs 20A, 20B are detached and attached according to the transformation of the vertical projection of the center of gravity. At least one of the supporting legs provided at the first abdominal plate 35 is/are capable of being detached and attached according to the transformation of the vertical projection of the center of gravity.

As illustrated in FIG. 8 and FIG. 9, the vertical projection of the center of gravity of the image forming apparatus is g1 and g2, supporting leg 21 and supporting leg 22 face each other across Y;

supporting leg 21 and supporting leg 22 are biased to E1 and E2, respectively;

supporting leg 20A and supporting leg 20B face each other across X;

supporting leg 20A and supporting leg 20B are biased to Y of the first abdominal plate 35;

D3 is greater than D1,

D3 is greater than D2.

D4 is greater than D1,

D4 is greater than D2, and a proportion of D6 to D5 is set from 5 to 3.

As described above, the image forming apparatus having a plurality of supporting legs, is capable of supporting various apparatus configurations.

The present invention is capable to be applied to various image forming apparatus, for example an image forming apparatus that forms a black and white image. Numerous additional modifications and variations of the present invention are possible in light of the above disclosure.

The invention claimed is:

1. An apparatus for supporting bottom surface of an image device, comprising:

a main body including a chassis having a bottom plate with first and second holding portions;

a first supporting leg configured to be selectably connectable to one of the first and second holding portions of the main body;

a second supporting leg connected to the main body;

a third supporting leg connected to the main body, wherein the first holding portion, the second supporting leg and third supporting leg are positioned on the main body such that a center of gravity of a virtual triangle connecting a location of the first holding portion on the main body, a location that the second supporting leg connects to the main body, and a location that the third supporting leg connects to the main body coincides with a position of a center of gravity of the main body; and an optional unit configured to be mounted to the main body, wherein the position of the center of gravity of the main body not including the optional unit is different from a position of a center of gravity of the main body including the optional unit.

2. The apparatus according to claim 1, wherein the first and second holding portions are configured to clamp the first supporting leg.

3. The apparatus according to claim 1, wherein the first and second holding portions include first and second eyemarks.

4. The apparatus according to claim 1, wherein the second holding portion, the second supporting leg and third supporting leg are positioned on the main body such that a center of gravity of a virtual triangle connecting a location of the second holding portion on the main body, the location that the second supporting leg connects to the main body, and the location that the third supporting leg connects to the main body coincides with a position of a center of gravity of the main body including the optional unit.

* * * * *